US006499674B2

(12) United States Patent
Ren et al.

(10) Patent No.: US 6,499,674 B2
(45) Date of Patent: Dec. 31, 2002

(54) AIR ASSIST FUEL INJECTOR WITH MULTIPLE ORIFICE PLATES

(76) Inventors: Wei-Min Ren, 148 Spoon Ct., Yorktown, VA (US) 23693; Jingming J. Shen, 907 Elder Rd., Newport News, VA (US) 23608

( * ) Notice: Subject to any disclaimer, the term of this patent is extended or adjusted under 35 U.S.C. 154(b) by 2 days.

(21) Appl. No.: 09/739,443

(22) Filed: Dec. 18, 2000

(65) Prior Publication Data

US 2002/0074431 A1 Jun. 20, 2002

(51) Int. Cl.[7] ..... B05B 7/12; B05B 1/34; F02M 61/00

(52) U.S. Cl. ..... 239/407; 239/408; 239/409; 239/412; 239/533.12; 239/533.14; 239/585.1; 239/585.2; 239/585.3; 239/585.5; 239/596

(58) Field of Search ..... 239/407, 408, 239/409, 412, 533.2, 533.12, 533.14, 533.15, 585.1, 585.2, 585.3, 585.4, 585.5, 596, 900

(56) References Cited

U.S. PATENT DOCUMENTS 5,402,937 A * 4/1995 Buchholz et al. ..... 239/585.5
5,553,789 A * 9/1996 Findler et al. ..... 239/585.1
5,553,790 A * 9/1996 Findler et al. ..... 239/585.1

FOREIGN PATENT DOCUMENTS

DE 4112150 * 3/1992

* cited by examiner

*Primary Examiner*—Robin O. Evans

(57) ABSTRACT

A fuel injector is provided. The fuel injector also includes a multi-layer orifice plate assembly located at the housing outlet. The orifice plate assembly includes a first orifice plate having a plurality of first openings extending therethrough and a second orifice plate disposed proximate to the first orifice plate. The second orifice plate includes a first face having a perimeter, and a plurality of channels extending radially therethrough to the longitudinal axis. The second orifice plate also includes a second face disposed opposite the first face and a plurality of second openings extending between the first face and the second face. The fuel injector also includes an air assist sleeve disposed about the housing proximate to the outlet. The air assist sleeve includes at least one air channel in communication with the plurality of channels. A method of providing a fuel/air mixture is also provided.

20 Claims, 6 Drawing Sheets

AIR ASSIST FUEL INJECTOR WITH MULTIPLE ORIFICE PLATES

FIELD OF THE INVENTION

The present invention relates generally to fuel injectors of the type that are used to inject liquid fuel into the air induction system of an internal combustion engine and particularly to a fuel injector with multiple orifice plates and an atomizer that fits over the nozzle of such a fuel injector and serves to convey assist air to the orifice plates to promote the atomization of the injected liquid fuel that has just left the nozzle.

BACKGROUND OF THE INVENTION

Air assist atomization of the liquid fuel injected from the nozzle of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

Air assist atomization technology is known. The technology recognizes the benefits that can be gained by the inclusion of special assist air passages that direct the assist air into interaction with the injected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is known by the inventors to mount the fuel injectors in an engine manifold or fuel rail which is constructed to include assist air passages for delivering the assist air to the individual injectors.

It is known to construct an air assist atomizer in which the definition of the final length of the assist air passage to each fuel injector tip is provided by the cooperative organization and arrangement of two additional parts which form an atomizer assembly disposed between the nozzle of an injector and the wall of a socket that receives the injector. One advantage of that invention is that it adapts an otherwise conventional electrically-operated fuel injector for use in an air assist system without the need to make modifications to the basic injector, and without the need to make special accommodations in the injector-receiving socket other than suitably dimensioning the socket to accept the air assist atomizer.

BRIEF SUMMARY OF THE PRESENT INVENTION

Briefly, the present invention provides a fuel injector. The fuel injector includes a housing having an inlet, an outlet a longitudinal axis extending therethrough, and a seat disposed proximate to the outlet. The seat includes a sealing surface and a passage extending therethrough. The fuel injector also includes a needle being reciprocally located within the housing along the longitudinal axis between a first position wherein the needle is displaced from the seat, allowing fuel flow past the needle, and a second position wherein the needle is biased against the seat, precluding fuel flow past the needle. The fuel injector also includes a multi-layer orifice plate assembly located at the housing outlet. The orifice plate assembly includes a first orifice plate having a plurality of first openings extending therethrough and a second orifice plate disposed proximate the first orifice plate. The second orifice plate includes a first face having a perimeter, a wall generally extending from the first face and circumscribing the perimeter, and a plurality of channels extending radially therethrough from the longitudinal axis toward the perimeter. The second orifice plate also includes a second face disposed opposite the first face and a plurality of second openings extending between the first face and the second face. The fuel injector also includes an air assist sleeve disposed about the housing proximate the outlet. The air assist sleeve includes at least one air channel in communication with the plurality of channels.

The present invention also provides a fuel injector comprising a housing having an inlet, an outlet, a longitudinal axis extending therethrough, and a seat disposed proximate the outlet. The seat includes a sealing surface and a passage extending therethrough. The fuel injector also includes a needle reciprocally located within the housing along the longitudinal axis between a first position wherein the needle is displaced from the seat, allowing fuel flow past the needle, and a second position wherein the needle is biased against the seat, precluding fuel flow past the needle. The fuel injector also includes a multi-layer orifice plate assembly located at the housing outlet. The orifice plate assembly includes a first orifice plate having a plurality of first openings extending therethrough, a second orifice plate having a plurality of second openings extending therethrough and in communication with the first openings, and a third orifice plate located between the first orifice plate and the second orifice plate. The third orifice plate is separate from the first and second orifice plates. The third orifice plate includes an outer perimeter and a plurality of radial channels extending from the outer perimeter toward the longitudinal axis. The fuel injector also includes an air assist sleeve disposed about the housing proximate the outlet. The air assist sleeve includes at least one air channel in communication with radial channels.

The present invention also provides a method of directing a fuel/air mixture through a fuel injector. The method comprises providing a fuel injector having a housing having an inlet, an outlet, a longitudinal axis extending therethrough, and a seat disposed proximate to the outlet, the seat including a sealing surface and a passage extending therethrough. The fuel injector also includes a needle being reciprocally located within the housing along the longitudinal axis between a first position wherein the needle is displaced from the seat, allowing fuel flow past the needle, and a second position wherein the needle is biased against the seat, precluding fuel flow past the needle. The fuel injector also includes a multi-layer orifice plate assembly located at the housing outlet. The orifice plate assembly includes a first orifice plate having a plurality of first openings extending therethrough and a second orifice plate disposed proximate to the first orifice plate. The second orifice plate includes a first face having a perimeter, a plurality of channels extending radially therethrough from the longitudinal axis toward the perimeter, a second face disposed opposite the first face, and a plurality of second openings extending between the first face and the second face. The fuel injector also includes an air assist sleeve disposed about the housing proximate to the outlet. The air assist sleeve includes at least one air channel in communication with the plurality of channels. The method further comprises directing fuel through the first openings; mixing assist air from the assist air channel with the fuel between the first orifice plate and the second orifice plate, forming a fuel/air mixture; and directing the fuel/air mixture through the second openings.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the futures of the invention. In the drawings.

DETAILED DESCRIPTION OF THE PREFERRED EMBODIMENTS

Figure 1:
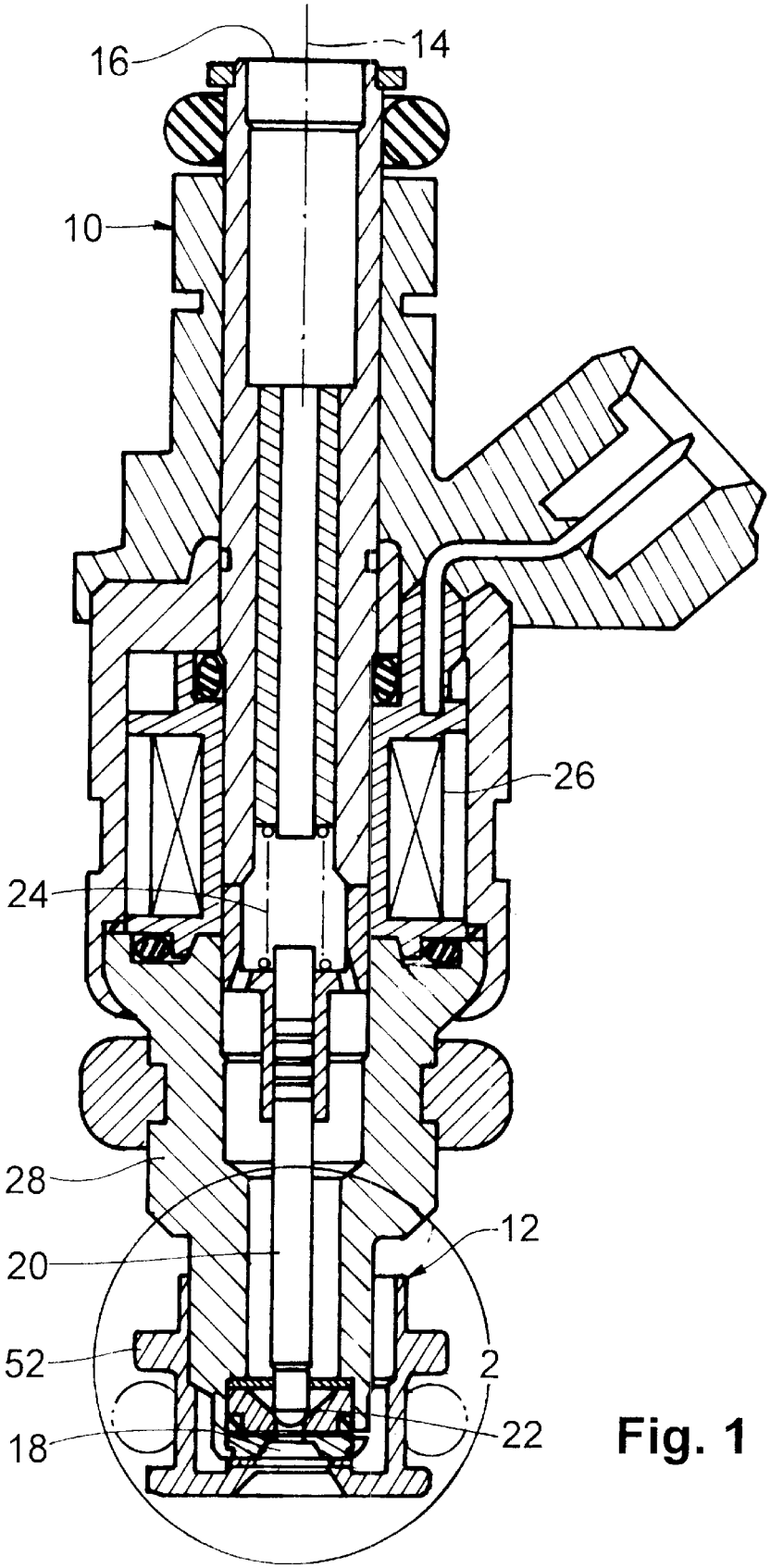
FIG. 1 is a side view, in section of a fuel injector according to a first preferred embodiment of the present invention.
Figure 2:
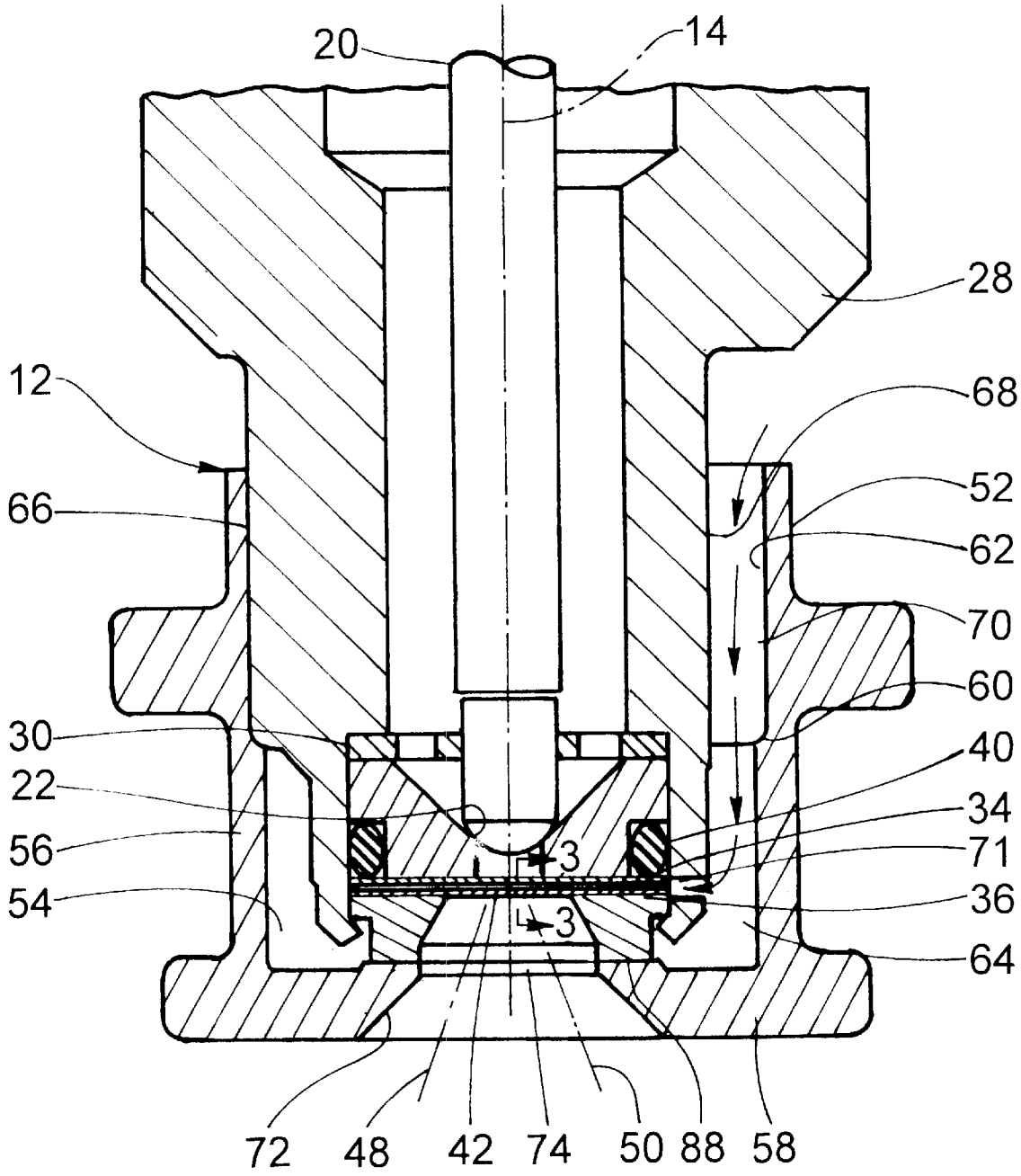
FIG. 2 is an enlargement of the encircled portion of the fuel injector shown in FIG. 1.

FIGS. 1–2 illustrate an electrically operated fuel injector 10 containing an air assist atomizer 12 with an orifice plate assembly 34 embodying principles of the invention. As used herein, like numbers indicate like elements throughout. Referring to FIG. 1, the fuel injector 10 has a main longitudinal axis 14 and is a top-feed type device comprising an inlet 16 and an outlet nozzle 18 at its opposite axial ends. The passage of liquid fuel through the fuel injector between inlet 16 and nozzle 18 is controlled by the seating and unseating of the rounded tip end of a metal needle 20 on and from a seat 22 located just interior of the nozzle 18. The needle 20 is reciprocally biased by a spring 24 to seat on the seat 22 thereby closing the passage to flow. When the needle 20 is electrically energized by the delivery of electric energizing current to the solenoid coil 26, the needle 20 unseats to allow fuel flow. FIGS. 1 and 2 show the fuel injector 10 in a closed condition.

The construction in the vicinity of the nozzle 18 is shown in greater detail in FIG. 2. The fuel injector 10 comprises a generally tubular metal housing 28 which contains in order of assembly at the nozzle end, a metal needle guide member 30, the seat 22, the orifice plate assembly 34, and a metal retainer member 36. An O-ring seal 40 is disposed between the seat 22 and the inside wall of housing 28.

The air assist atomizer 12 is disposed around the fuel injector 10 proximate the nozzle 18. The air assist atomizer includes a sleeve or shroud 52. The shroud 52 possesses a general cap shape having a side wall 56 and an end wall 58. A portion of housing 28 has a nominally circular outside diameter 66 that is dimensioned to allow portion 62 of shroud 52 to fit onto it and be retained. However, that nominally circular outside diameter 66 is provided with one or more interruptions, such as an axial flat or slot 68, so as to thereby cooperatively define with the side wall of the shroud 52 an entrance portion of an axially extending shroud channel or passage 70 for assist air to flow axially along the outside of housing 28 toward the orifice plate assembly 34. The small arrows in FIG. 2 represent the assist air flow. The passage 70 communicates with the orifice plate assembly 34 via at least one radial air channel 71 to provide assist air from the passage 70 to the orifice plate assembly 34. Although only one air channel 71 is shown, those skilled in the art will recognize that more than one air channel 71, such as four air channels 71 spaced about the nozzle 18, can be used.

When the fuel injector is in an open condition, the pressurized fuel that is supplied to the injector via the inlet 16 is injected from the nozzle 18 in distinctly divergent directions represented generally by the respective numerals 48, 50 in FIG. 2. The construction of the injector 10 and its nozzle 18 which has thus far been described is generally like that disclosed in certain commonly assigned U.S. patents such as U.S. Pat. No. 5,174,505, which is hereby expressly incorporated by reference, and therefore will not be described further so that the innovative features of the orifice plate assembly 34 and its association with the air assist atomizer 12 can be described.

Figure 3:
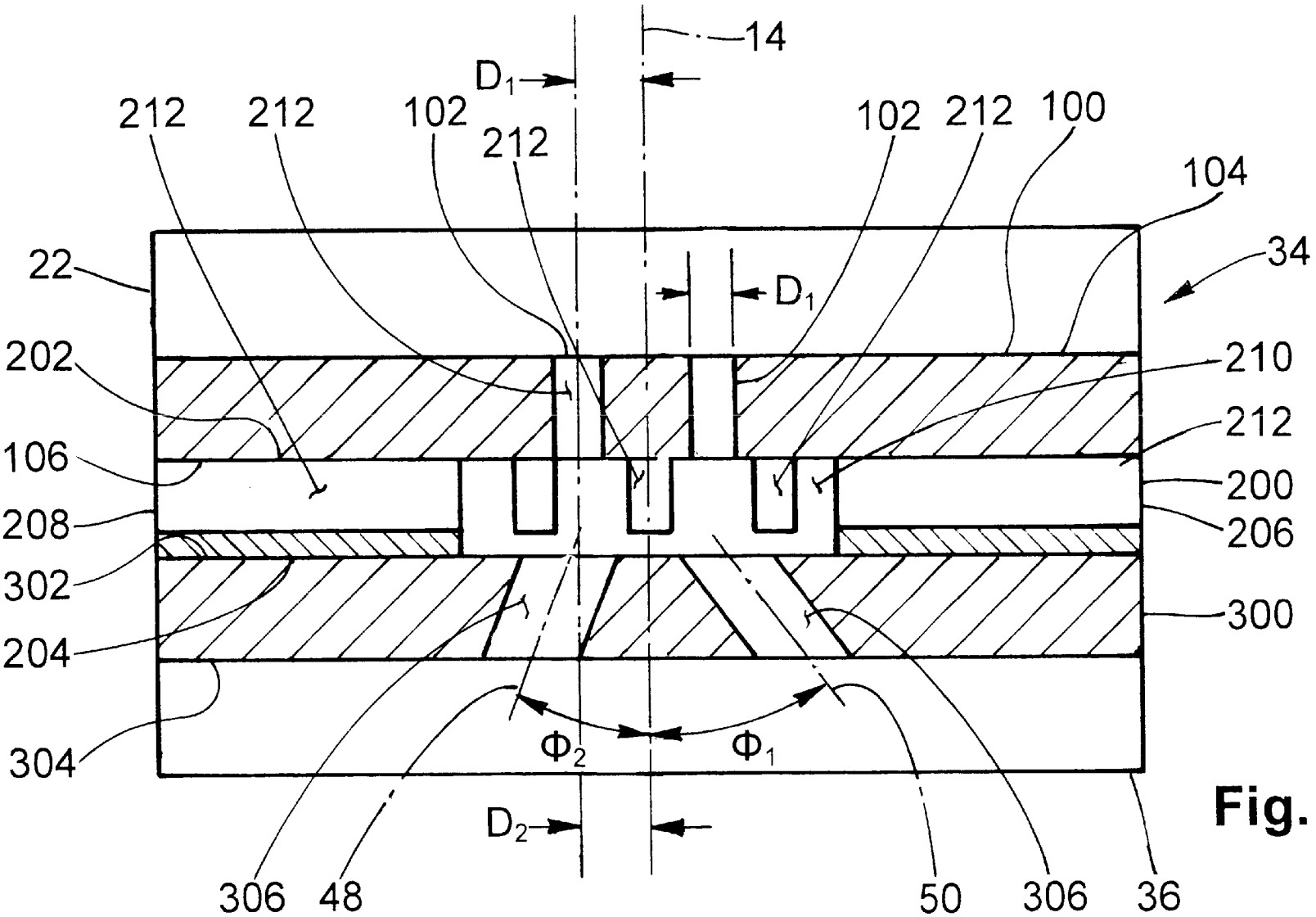
FIG. 3 is a side view taken along the section line 3—3 shown in FIG. 2 of a multi-plate orifice assembly according to the first preferred embodiment of the present invention.
Figure 4:
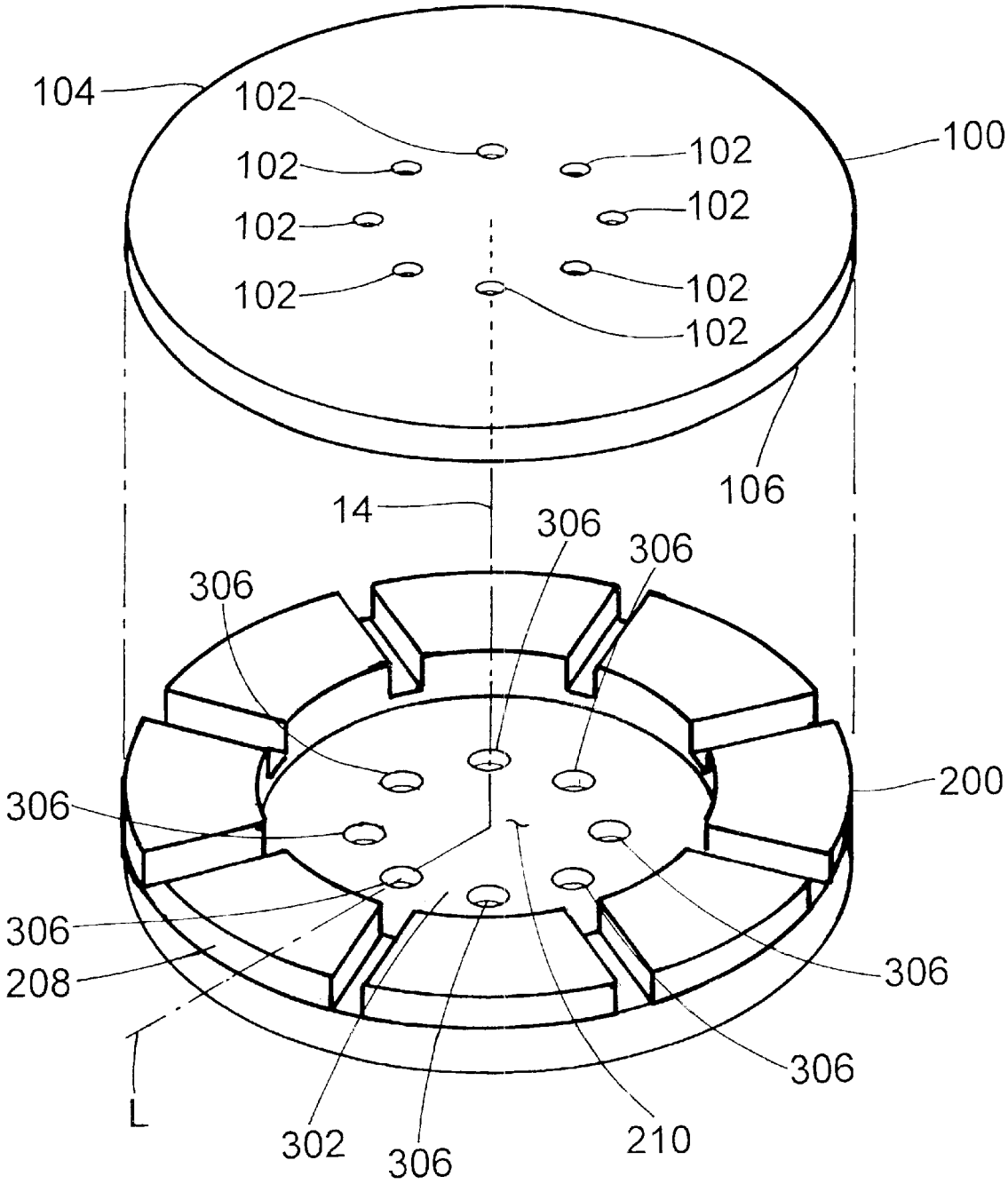
FIG. 4 is a partially exploded perspective view of the multi-plate orifice assembly shown in FIG. 3.

The orifice plate assembly 34 is preferably comprised of three orifice plates: a first, or top, orifice plate 100, a second, or middle, orifice plate 200, and a third, or bottom orifice plate 300. A cross-section of the orifice plate assembly 34 is shown in FIG. 3 and a partially exploded perspective view is shown in FIG. 4. The top orifice plate 100 includes a plurality of openings 102 which extends through the plate 100 from a top surface 104 to a bottom, opposing surface 106. Preferably, eight openings 102 are radially spaced about the longitudinal axis 14 at a first predetermined distance $D_1$. The openings 102 are preferably symmetrically spaced from the longitudinal axis 14 and approximate a circular shape as shown in FIG. 4. However, those skilled in the art will recognize that more or less than eight openings 102 can be formed in the plate 100. Further, the openings 102 preferably have a diameter "$d_1$". Preferably, the plurality of openings 102 are immediately downstream and adjacent to the seat 22, as shown in FIG. 2.

The bottom orifice plate 300 has the upstream face 302, a downstream face 304, and a plurality of preferably circular metering holes or openings 306 extending through the bottom orifice plate 300 and radially spaced a second predetermined distance "$D_2$" from the longitudinal axis 14.

The openings 306 are preferably symmetrically spaced from the longitudinal axis 14 and approximate a circular shape as shown in FIG. 4.

Preferably, eight openings 306 are preferred, although those skilled in the art will recognize that more or less than eight openings 306 can be used. Preferably, the number of openings 306 in the bottom plate 300 equals the number of openings 102 in the top plate 100, and each opening 306 in the bottom plate 300 is radially spaced from the longitudinal axis 14 the distance $D_2$ generally the same distance $D_1$ as each respective opening 102 in the top plate 100 such that each opening 102 is axially aligned with a respective opening 306.

Preferably, the openings 306 extend generally obliquely from the longitudinal axis 14. Although not required, an opening 306 can extend from the longitudinal axis 14 at a first angle $\Phi_1$, and a second opening 306 can extend from the longitudinal axis 14 a second angle $\Phi_2$, which is different from the first angle $\Phi_1$.

Figure 5:
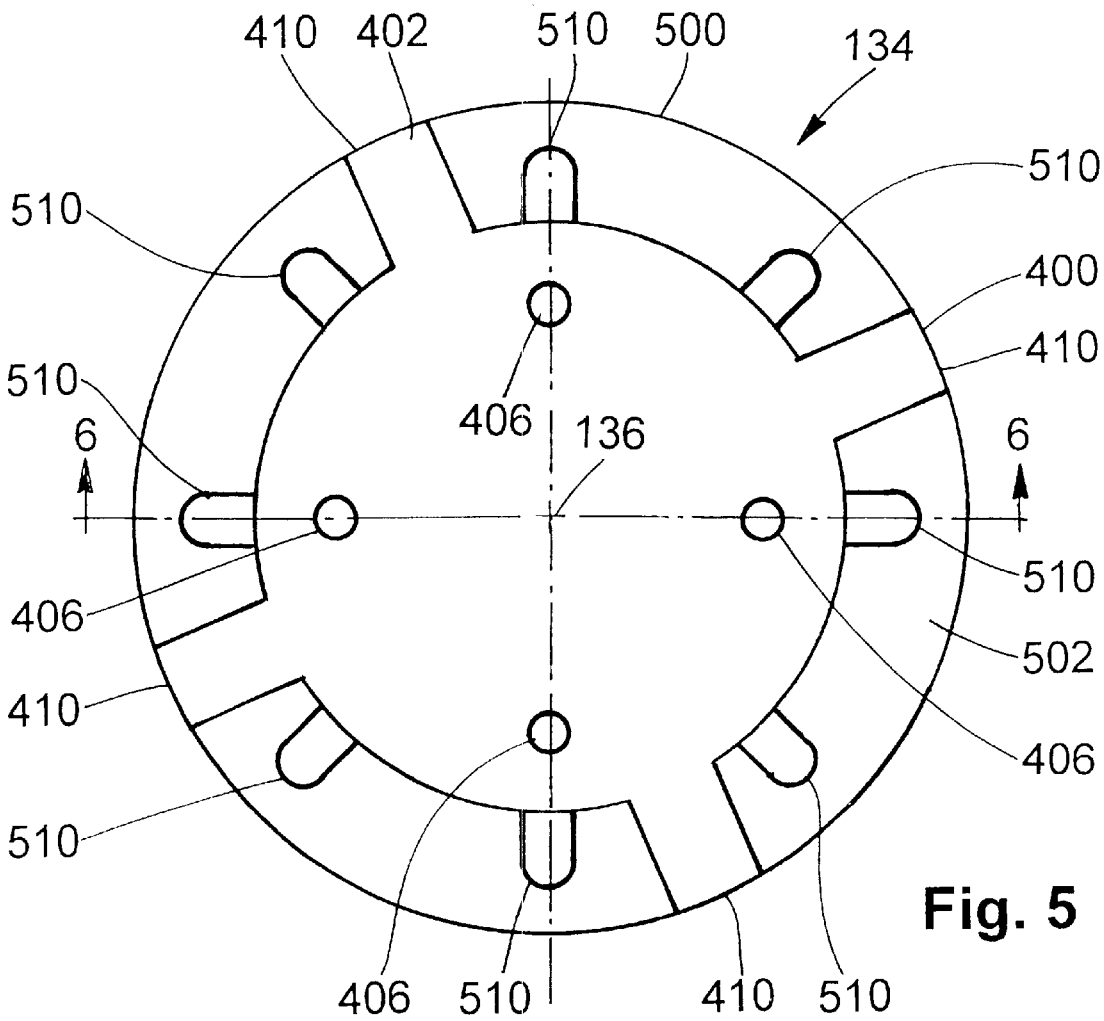
FIG. 5 is a top plan view of a second preferred embodiment of the present invention.

The middle orifice plate 200, shown in FIG. 3, between the top and bottom orifice plates 100, 300, is used to radially direct air from the passage 70 to the fuel after the fuel passes through the top plate 100 and prior to the fuel passing through the bottom plate 300. As shown in FIGS. 2 and 5, the middle orifice plate 200 includes an upstream face 202, a downstream face 204, and an outer perimeter 206. A wall 208 surrounds the outer perimeter 206 and extends upward toward the top orifice plate 100. A central cavity generator 210 extends radially from the longitudinal axis 14 to the wall 208.

A plurality of channels 212 extend through the wall 208 from the outer perimeter 206 and radially to the cavity generator 210. As shown in FIG. 3, the channels 212 are open on the upstream face 202, although those skilled in the art will recognize that the channels 212 can be open on the downstream face 204 instead. Preferably, eight channels 212 are present and the channels 212 are aligned with the openings 306 in the bottom plate 300 such that a virtual line "L", shown in FIG. 4, which begins at the longitudinal axis 14 and extends through any channel 212 also generally intersects a respective opening 306 in the bottom plate 300.

In operation, liquid fuel is injected through the openings 102. The fuel flows down stream past the openings 102 and channels 212 and out through openings 306. Air flows around the fuel jets and is injected through the openings 306. The openings 306 are designed so that the air flow reaches the speed of sound at the openings 306. The resulted high velocity improves the atomization quality of the fuel and air mixture. In the case of the illustrated fuel injector 10, the injections along the directions 48, 50 will be nebulized by the atomizer into the shape of respective clouds, as distinguished from narrower streams generated by a similar injector (not shown) without the air assist feature.

Although three orifice plates 100, 200, 300 are preferred, those skilled in the art will recognize that the middle orifice plate 200 can be combined with either the top orifice plate 100 or the bottom orifice plate 300, resulting in an orifice plate assembly with only two orifice plates, and that the plurality of channels can be formed in either of the top plate 100 or the bottom plate 300.

A second embodiment of an orifice plate assembly 134 is shown in FIGS. 5–8. The orifice plate assembly 134 is constructed from a first, or top, orifice plate 400, a second, or middle plate 500, and a third, or bottom plate 600. The orifice plate assembly 134 is disposed in the fuel injector 10 in the same location as the orifice plate assembly 34.

The top orifice plate 400 includes a top surface 402 and a bottom surface 404. In a preferred embodiment, four openings 406 are radially disposed about a longitudinal axis 136 and extend through the plate 400 between the top surface 402 and the bottom surface 404. Although four openings 406 are preferred, those skilled in the art will recognize that more or less than four openings 406 can be present.

Preferably, the openings 406 extend generally oblique to the longitudinal axis 136, such that the openings 406 extend generally downward and away from the axis 136. Preferably, each opening 406 extends from the longitudinal axis 136 at the same angle, although those skilled in the art will recognize that the openings 406 can extend at different angles from the longitudinal axis 136. A plurality of tangs 410, preferably eight in number, extend generally radially outward from the plate 400, forming an opening for air flow between each tang 410.

Figure 6:
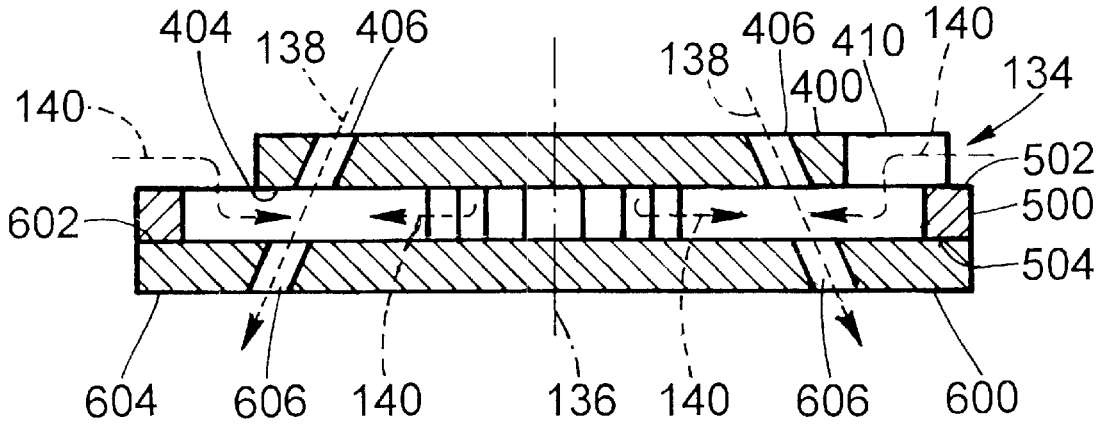
FIG. 6 is a sectional view of the second preferred embodiment of the present invention taken along line 6—6 of FIG. 5.
Figure 7:
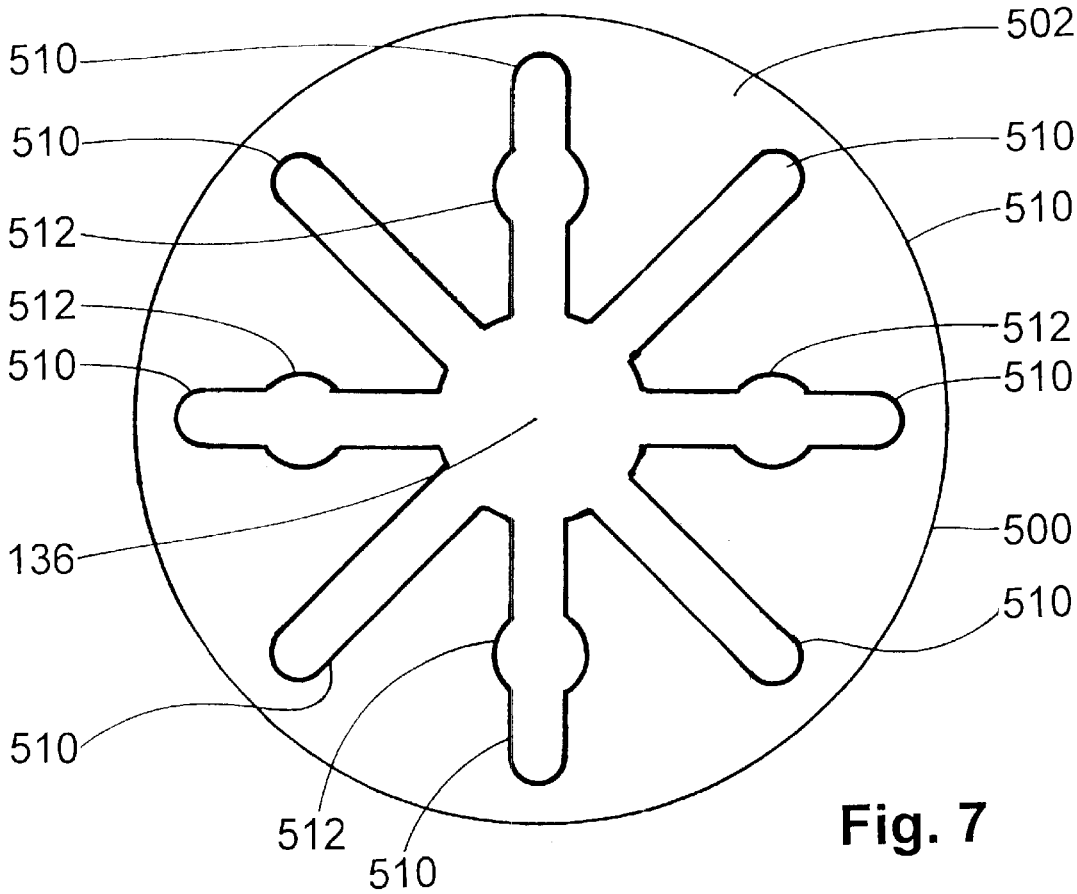
FIG. 7 is a top plan view of a middle plate of the second preferred embodiment of the present invention.
Figure 8:
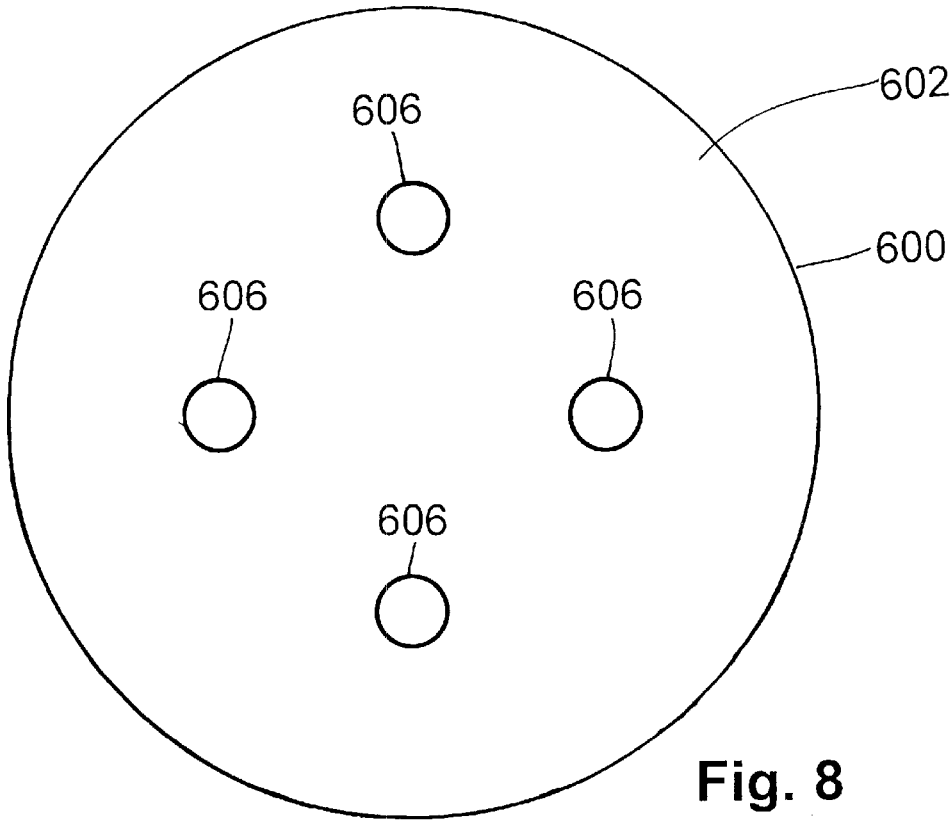
FIG. 8 is a top plan view of a bottom plate of the second preferred embodiment of the present invention.

The middle plate 500 includes a top surface 502 and a bottom surface 504. A plurality of channels or slots 510 extend radially from the longitudinal axis 136 toward the perimeter of the plate 500. Preferably, the number of slots 510 is generally two times the amount of openings 406. As shown in FIG. 7, eight slots 510 are present. As shown in FIGS. 5 and 6, for each of the four openings 406, a slot 510 extends from the longitudinal axis 136 and communicates with the respective opening 406. For those slots 510, a generally circular enlargement 512 of the channel 510 is present to circumscribe the opening 406 at the bottom surface 404. Each slot 510 is sufficiently long so that an end of each slot 510 extends beyond the top plate 400, and so that a portion of each slot 510 is uncovered by the top plate 400 between each tang 410.

The bottom plate 600 includes a top surface 602 and a bottom surface 604. In a preferred embodiment, four openings 606 are radially disposed about a longitudinal axis 136 and extend through the plate 600 between the top surface 602 and the bottom surface 604. Although four openings 606 are preferred, those skilled in the art will recognize that more or less than four openings 606 can be present, as long as the number of openings 606 equals the number of openings 406. Preferably, each opening 606 is larger than each respective opening 406.

Preferably, the openings 606 extend generally oblique to the longitudinal axis 136, such that the openings 606 extend generally downward and away from the axis 136. Preferably, each opening 606 extends from the longitudinal axis 136 at the same angle, although those skilled in the art will recognize that the openings 606 can extend at different angles from the longitudinal axis 136. Each opening 606 is aligned with a respective opening 406, as shown in FIG. 6, so that fuel can flow in a generally straight line through an opening 406 and a respective opening 606, as shown by the dotted line 138.

As with the first embodiment of the orifice plate assembly 34, the orifice plate assembly 134 is preferably constructed from a metal.

In operation, fuel is injected through the openings 406. The flow of liquid through the openings 406 creates a liquid jet. Air flows through the channels 510 from the area between the tangs 510, as shown by the dashed arrows 140 in FIG. 6. The liquid jet creates an air flow perpendicular to the liquid jet and impinges at the liquid jet. The impinged fuel flows through each channel 510 and out an enlargement 512. For the channels without an enlargement 512, the air flow generally travels through the channel 510 toward the longitudinal axis 136. The fuel is then injected through the openings 606 where the fuel is nebulized into a fuel cloud prior to injection.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector comprising:

a housing having an inlet, an outlet and a longitudinal axis extending therethrough;

a seat disposed proximate the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat, precluding fuel flow past the needle;

a multi-layer orifice plate assembly located at the housing outlet, the orifice plate assembly including:

a first orifice plate having a plurality of first openings extending therethrough; and a second orifice plate disposed proximate to the first orifice plate, the second orifice plate including a first face having a central cavity located about the longitudinal axis and a perimeter, a plurality of channels extending radially from the central cavity toward the perimeter, a second face adjacent the first face, and a plurality of second openings extending through the second face; and an air assist sleeve disposed about the housing proximate the outlet, the air assist sleeve including at least one air channel in communication with the plurality of channels.

2. The fuel injector according to claim 1, wherein the plurality of first openings are each spaced a first predetermined radial distance from the longitudinal axis and the plurality of second openings are each spaced a second predetermined radial distance from the longitudinal axis.

3. The fuel injector according to claim 2, wherein the second predetermined radial distance is generally the same as the first predetermined radial distance.

4. The fuel injector according to claim 1, wherein at least one of the first and second orifice plates comprises metal.

5. The fuel injector according to claim 1, wherein the plurality of first openings equals the plurality of second openings.

6. The fuel injector according to claim 5, wherein each of the plurality of first openings is axially aligned with a respective one of the plurality of second openings.

7. The fuel injector according to claim 1, wherein the plurality of second openings extends in a generally oblique direction from the longitudinal axis.

8. The fuel injector according to claim 7, wherein the generally oblique direction comprises a first direction and a second direction.

9. The fuel injector according to claim 1, wherein the first openings have a first size and the second openings have a second size, larger than the first size.

10. A fuel injector comprising:

a housing having an inlet, an outlet and a longitudinal axis extending therethrough;

a seat disposed proximate the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat, precluding fuel flow past the needle; and a multi-layer orifice plate assembly located at the housing outlet, the orifice plate assembly including:

a first orifice plate having a plurality of first openings extending therethrough;

a second orifice plate having a plurality of second openings extending therethrough and in communication with the first openings; and a third orifice plate located between the first orifice plate and the second orifice plate, the third orifice plate being separate from the first and second orifice plates, the third orifice plate including a central cavity located about the longitudinal axis with an outer perimeter and a plurality of radial channels extending from the central cavity toward the outer perimeter; and an air assist sleeve disposed about the housing proximate to the outlet, the air assist sleeve including at least one air channel in communication with radial channels.

11. The fuel injector according to claim 10, wherein the plurality of first openings are each spaced a first predetermined radial distance from the longitudinal axis and the plurality of second openings are each spaced a second predetermined radial distance from the longitudinal axis.

12. The fuel injector according to claim 11, wherein the second predetermined radial distance is generally the same as the first predetermined radial distance.

13. The fuel injector according to claim 10, wherein the plurality of first openings equals the plurality of second openings.

14. The fuel injector according to claim 13, wherein each of the plurality of first openings is axially aligned with a respective one of the plurality of second openings.

15. The fuel injector according to claim 10, wherein the plurality of second openings extends in a generally oblique direction from the longitudinal axis.

16. The fuel injector according to claim 15, wherein the generally oblique direction comprises a first direction and a second direction.

17. The fuel injector according to claim 10, wherein at least one of the first, second, and third orifice plates comprises metal.

18. The fuel injector according to claim 10, wherein the first openings have a first diameter and the second openings have a second diameter, larger than the first diameter.

19. A method of directing a fuel/air mixture through a fuel injector comprising:

providing a fuel injector having:

a housing having an inlet, an outlet and a longitudinal axis extending therethrough;

a seat disposed proximate to the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat, precluding fuel flow past the needle;

a multi-layer orifice plate assembly located at the housing outlet, the orifice plate assembly including:

a first orifice plate having a plurality of first openings extending therethrough; and a second orifice plate disposed proximate to the first orifice plate, the second orifice plate including a first face having a central cavity located about the longitudinal axis and a perimeter, a plurality of channels extending radially from the central cavity toward the perimeter, a second face adjacent the first face, and a plurality of second openings extending through the second face; and an air assist sleeve disposed about the housing proximate to the outlet, the air assist sleeve including at least one air channel in communication with the plurality of channels;

directing fuel through the first openings;

mixing assist air from the assist air channel with the fuel between the first orifice plate and the second orifice plate, forming a fuel/air mixture; and directing the fuel/air mixture through the second openings.

20. The method according to claim 19, wherein the directing the fuel/air mixture through the second openings comprises directing the fuel/air mixture away from the longitudinal axis.

* * * * *